US005820919A

United States Patent [19]

Terai

[11] Patent Number: 5,820,919

[45] Date of Patent: Oct. 13, 1998

[54] METHOD OF MANUFACTURING A LIQUID JET RECORDING HEAD

[75] Inventor: Haruhiko Terai, Yokohama, Japan

[73] Assignee: Canon Kabushiki Kaisha, Tokyo, Japan

[21] Appl. No.: 778,287

[22] Filed: Jan. 2, 1997

Related U.S. Application Data

[62] Division of Ser. No. 984,838, Dec. 3, 1992, Pat. No. 5,596,357.

[30] Foreign Application Priority Data

Dec. 4, 1991 [JP] Japan ..... 3-320601

[51] Int. Cl.[6] ..... B05D 5/12

[52] U.S. Cl. ..... 427/58; 427/261; 427/299; 427/419.2

[58] Field of Search ..... 427/256, 261, 427/419.2, 299, 58

[56] References Cited

U.S. PATENT DOCUMENTS

| | | | |
|---|---|---|---|
| 4,313,124 | 1/1982 | Hara | 346/140 R |
| 4,345,262 | 8/1982 | Shirato et al. | 346/140 R |
| 4,459,600 | 7/1984 | Sato et al. | 346/140 R |
| 4,463,369 | 7/1984 | Ayata et al. | 346/1.1 |
| 4,558,333 | 12/1985 | Sugitani et al. | 346/140 R |
| 4,608,577 | 8/1986 | Hori | 346/140 R |
| 4,723,129 | 2/1988 | Endo et al. | 346/1.1 |
| 4,725,849 | 2/1988 | Koike et al. | 346/1.1 |
| 4,740,796 | 4/1988 | Endo et al. | 346/1.1 |
| 4,809,428 | 3/1989 | Aden et al. | 29/611 |
| 5,469,200 | 11/1995 | Terai | 347/63 |

FOREIGN PATENT DOCUMENTS

| | | |
|---|---|---|
| 54-56847 | 5/1979 | Japan . |
| 59-123670 | 7/1984 | Japan . |
| 59-138461 | 8/1984 | Japan . |
| 60-71260 | 4/1985 | Japan . |
| 2-125741 | 5/1990 | Japan . |

OTHER PUBLICATIONS

Wolf, S. et al. "Silicon Processing for the VLSI Era, vol. 1: Process Technology", Lattice Press (1986), pp. 40–56 and 532–534. (No month avail.).

*Primary Examiner*—Bernard Pianalto
*Attorney, Agent, or Firm*—Fitzpatrick, Cella, Harper & Scinto

[57] ABSTRACT

A substrate for liquid jet recording head comprises a supporting member with an oxidized film on its surface, exothermic resistive members arranged on the supporting member, and wirings electrically connected to the exothermic resistive members. For the substrate, it is arranged that the dislocation density in the area beneath the oxidized film on said supporting member is less than $5\times10^4$ pieces/cm$^2$; hence eliminating the curves of the substrate which will be created when it is cut for the fabrication of a liquid jet recording head.

2 Claims, 6 Drawing Sheets

METHOD OF MANUFACTURING A LIQUID JET RECORDING HEAD

This application is a division of application Ser. No. 07/984,838, filed Dec. 3, 1992, now U.S. Pat. No. 5,596,357.

BACKGROUND OF THE INVENTION

1. Field of the Invention

The present invention relates to a substrate using a monocrystal material. More particularly, the present invention relates to a substrate using a monocrystal substrate the surface of which is thermally oxidized, a liquid jet recording head substrate using the foregoing substrate, a method of manufacture of such a substrate, a liquid jet recording head using such a substrate, and a recording head provided with such a recording head.

2. Related Background Art

Of the ink jet recording methods which can be used for various printers, copying machines, facsimile apparatuses, and others, a liquid jet recording method wherein recording liquid is thermally activated to fly it for the recording performance is the recording method which has attracted a particular interest in the art recently because compared to the impact printer and other recording methods, it is capable of performing recording with a lesser noise yet at a high speed. Moreover, with this method, it is possible to achieve a highly precise recording of a higher image quality by the use of a compact recording apparatus.

A liquid jet recording head using such a liquid recording method is, for example, structured as shown in FIGS. 5A and 5B such that on a supporting member 1, exothermic resistive members 2*a* are arranged as thermal energy generating elements to generate the thermal energy to activate liquid to form a substrate 8, and in the positions corresponding to the exothermic resistive members 2*a* thereon, there are formed liquid passages 6 conductively connected to the discharging ports (orifices) 7 to eject liquid, and a liquid chamber 10 which supplies liquid to the foregoing passages. In FIGS. 5A and 5B, a numeral 5 designates a ceiling board and 9, a liquid supply inlet.

Also, as shown in FIGS. 6A and 6B, at least an electrode layer 3 and an exothermic resistive layer 2 are laminated on the supporting member 1. The substrate 8 is thus obtained by forming the exothermic resistive members 2*a* electrically connected to the pairs of electrodes 3*a* and 3*b* provided at given intervals in a given configuration produced by patterning these layers.

In this respect, on the substrate 8 having the electrodes 3*a* and 3*b* as well as the exothermic resistive members 2*a*, a protective layer 4 and various other upper layers are provided as required.

As a supporting member 1 utilized for the formation of the substrate 8 for a liquid jet recording head structured such as this, a board type silicon, glass, or ceramics, or the like has hitherto been used.

Of these materials, silicon is often used for the substrate for the reasons given below.

In a case of a recording head structured on a substrate using a glass supporting member, an excessive heat accumulation takes place in the supporting member when the driving frequency of the exothermic resistive member is increased because of the inferior heat conductivity of the glass supporting member. As a result, liquid in the recording head is unnecessarily heated to contain bubbles. There is then a possibility that a disabled liquid ejection or the like occurs inevitably.

In a case of a ceramic supporting member, an alumina member is often used because compared to glass, it has a better conductivity, at the same time enabling the production of a substrate in a comparatively large size. However, since the alumina supporting member is produced by baking the powdered material, there tends to occur surface defects such as pin holes or extrusions of several $\mu$m to several ten $\mu$m on the surface of the supporting member. Accordingly, when wiring and other patterning are conducted on this supporting member, defects such as wiring opens or shorts with such defects as its starting points take place, leading to the yield reduction. Also, the surface roughness of the ceramic supporting member is usually Ra=approximately 0.15. It is often difficult to obtain an optimal smoothness required to form the deposited layer of a desirable durability for the electrothermal transducers and the like. Therefore, in the case of a recording head structured on the alumina supporting member, there is a possibility that the electrothermal transducers and others on the alumina supporting member which generates heat repeatedly are peeled or affected in some other ways; thus leading to a shorter durability in some cases.

There is of course means to improve the close contact between the supporting member and the electrothermal transducers and other by polishing the surface to increase the smoothness thereof. However, there is automatically a limit for the adjustment of the surface roughness because alumina is a highly hard material.

Also, an alumina grazed supporting member which is an alumina supporting member on which a greasing layer is provided enables the solution of the problem such as the presence of the pin holes, extrusions or other surface defectives as well as the surface roughness. However, the grazing layer cannot be formed in a thickness of less than 40 to 50 $\mu$m due to its method of manufacture. Consequently, there is a possibility as in the glass supporting member that an excessive heat accumulation takes place.

On the other hand, in a case where silicon supporting member 1 is used, there is no problem of the excessive heat accumulation such as encountered in the cases of the glass and ceramic supporting members 1. Particularly, when monocrystal silicon wafers are used, there is almost no possibility that the breakage of wiring and others as described above will take place because its surface condition is highly desirable. Therefore, as disclosed in Japanese Patent Laid-Open Application No. 2-125741, for example, the monocrystal silicon wafer is used for the supporting member for the above-mentioned liquid jet recording head which utilizes thermal energy.

Now, in recent years, there is an increasing desire to provide as early as possible a recording apparatus capable of performing recordings of a better image quality at a higher speed in the field of recording in which the liquid jet recording methods are employed. With a view to meeting such demands on the high-speed recording, the research and development have been made assiduously to make available a large recording head, the so-called full line head, to perform recordings on a wide recording medium.

As a result of such research and development, it is found that although the monocrystal silicon wafer is best suited for the foregoing recording head supporting member as far as the recording head can be comparatively small, there are problems yet to be solved in order to make the monocrystal silicon wafer usable as a supporting member for a large recording head because the drawbacks given below will ensue when it is used as the supporting member for a large recording head.

In other words, for a liquid jet recording head, a heat storage layer (lower layer) is provided in a thickness of 0.3 to 10 $\mu$m in order to obtain a desirable balance between the capabilities of heat accumulation and release for a better transfer of heat to the recording liquid. In this case, the aforesaid substrate is fabricated in such a manner that a heat accumulation layer of $SiO_2$ layer is formed by thermally oxidizing the surface of the monocrystal silicon wafer cut out from the monocrystal ingot, and then subsequent to having formed the foregoing exothermic resistive layer, wirings, and the like, it is cut per recording head.

However, according to the researches and experiments by the present inventor et al with a view to obtaining a large recording head, there is found a problem that substrates 1*a* and 1*b* cut out from the end portion of a monocrystal silicon are curved like a bow as shown in FIG. 1, respectively. Then, the maximum amount of such a deformation is as much as 60 to 90 $\mu$m, and the substrate is often broken if the deformation is forcibly corrected. Also, even when such a deformation is small, it becomes difficult to conduct its grinding machining properly after the cutting process, the accuracy of patterning becomes incorrect when the wirings are patterned on the supporting member, or the wirings arranged on the substrate can hardly be connected electrically to IC and others precisely among other problems thus found. It is also found that a liquid jet recording head which is fabricated with a curved substrate causes recording liquid to be displaced on a recording medium, leading to the missing or uneven recording dots to lower the quality of the recorded images. Also, if this portion where such a deformation takes place, that is, the end portion of a silicon wafer, is not used for the recording head substrate, it is found that the fabrication cost of the substrate itself becomes extremely high.

In order to avoid this, it is attempted to form the heat accumulation layer by the application of some other methods than the thermal oxidation, such as a vacuum film deposition (sputtering, thermal CVD, plasma CVD, ion beam, or the like). The results are, however, that the heat accumulation layer has an uneven distribution of film thickness, the film deposition speed becomes slower, or dust particles tend to be generated during the film deposition. These dust particles are mixed in the film to often create granular defects of several $\mu$m in size. When this type of defects is present, the exothermic resistive members formed on such defects tend to be broken by cavitation in durable ejection. In addition, there is a fear that if the supporting member is conductive, electric current leaks from the defective portions to cause a short circuit electrically.

As still another method to form the heat accumulation layer, a spin-on-glass or dip-and-pickup method may be used to perform silica coating. However, none of them presents a desirable film quality for the purpose. There is also a problem that the dust particles are mixed when the film is being coated.

As described above, the causes of the substrate deformation are constantly studied. As a result, it is found that such a curving deformation as this is not recognized on the portions of the substrate where no thermal oxidation layer is formed as the heat accumulation layer, and that the above-mentioned deformation is caused by the thermal oxidation processing. Then, it is further found that the occurrence of the foregoing deformations is due to the fact that the end portions of the wafer, particularly, four corners, are cooled most quickly when cooled after the thermal treatment is given to the monocrystal silicon wafer, and thus, as indicated by arrows in FIG. 2A, tensile stresses are generated along the outer periphery of the supporting member, Accordingly, in a state indicated by the marks + in FIG. 2B, the stresses are distributed in the supporting member to cause the generation of the plastic deformations; hence resulting in the dislocation. When the supporting member is formed by cutting a part of the wafer thus prepared as shown in FIG. 1, the resilient deformations which are present surrounding such dislocations are partly released to allow the deformations to take place.

Therefore, when the monocrystal silicon supporting member is used as a supporting member for a recording head substrate, there is automatically a limit in attaining the elongation of the substrate for the purpose. Consequently, it is required to combine short substrates for a recording head to integrate them for the provision of an elongated head for the achievement of a high speed recording. In this case, however, it is extremely difficult to adjust the junctions between such substrates so that no adverse effect will be produced on an image to be recorded.

Under such circumstances, there has been an increasing desire to make available at a low cost a liquid jet recording head substrate the configuration of which is not restricted by its fabrication processing, and is also capable of easily attaining high-speed and high-quality recordings without any problems such as the deformation of the recording head substrate associated with its size when it is made larger.

SUMMARY OF THE INVENTION

The present invention is designed with a view to solving the above-mentioned problems. It is an object of the invention to provide a liquid jet recording head substrate having a desirable heat releasing capability and an excellent durability, at the same time being adaptable to the elongation thereof with a higher yield than the conventional substrate when fabricated thereby to attain the manufacture of recording head at a low cost, a method of manufacture therefor, and a liquid jet recording head using such a recording head.

It is another object of the present invention to provide a recording apparatus provided with the above-mentioned recording head.

While attempting to achieve the above-mentioned objects, it is found by the present inventor et al that the conventional bowed curves can be eliminated almost completely by adjusting the dislocation density of the surface of the supporting member to be less than $1\times10^3$ pieces/cm$^2$ after the thermal oxidation.

It is also found, particularly, that according to the present invention, the dislocations can be adjusted with the reduction of the irregularity of the cooling speed after the thermal oxidation heating by machining to make the four corners of the substrate round or by reducing the cooling speed after the thermal oxidation heating.

In machining the four corners of the substrate round, the R shape of the corners of the substrate can be determined appropriately in consideration of the speed with which to take out the substrate from the furnace so as to define the dislocation density to be less than the above-mentioned setting value.

Also, in order to reduce the cooling speed after the thermal oxidation heating, the furnace cooling where the furnace itself is cooled before the substrate is taken out therefrom is gradually performed; thus taking out the substrate when the furnace is cooled to a certain extent. In this case, too, the furnace cooling speed, the temperature at which to take it out, and other various conditions can be determined appropriately in consideration of the substrate configuration so as to define the dislocation density to be less than the above-mentioned setting value.

DETAILED DESCRIPTION OF THE PREFERRED EMBODIMENTS

Hereinafter, the present invention will be described specifically in accordance with the embodiments thereof. It is to be understood, however, that the present invention is not limited to such embodiments.

Embodiment 1

At first, a high purity polycrystalline rod of less than 1 ppb residual impurity density is produced by hydrogen reduction and thermal decomposition of $SiHCl_3$ and is crushed for dissolution. Then, a monocrystal ingot which is produced by pulling up therefrom in the <IDO> direction using CZ method is finished by grinding to be a square column. With a multiwire saw, it is cut into boards which are then machined by lapping to remove the surface layer approximately 30 $\mu$m for smoothing.

Figure 3A:
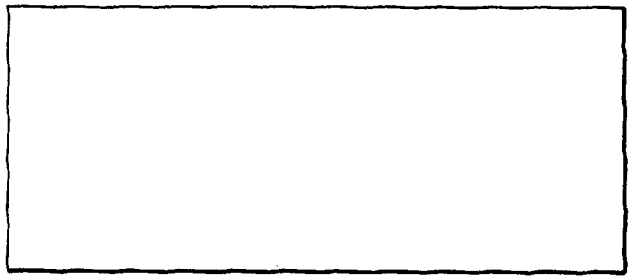
FIGS. 3A and 3B illustrate the substrate configurations according to an embodiment of the present invention.
Figure 3B:
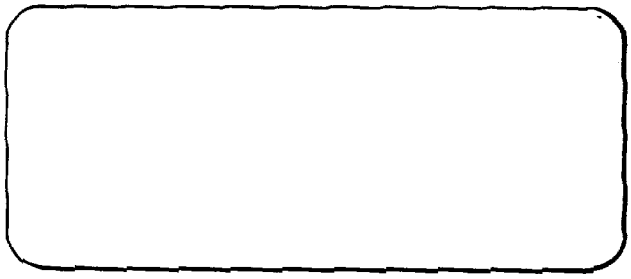

Subsequently, under conditions stated in Table 1, the corners of the respective substrates are rounded by differently and then lapped by machining to produce mirror surfaced substrate specimens each in size of 300 mm×150 mm×1.1 mm with the surface roughness of max 150 Å as shown in FIG. 3.

For these specimens, a thermal oxidation process is conducted in an atmosphere containing oxygen introduced by bubbling method at a heating temperature of 1,150° C. for 14 hours to form a thermal oxidation layer of 2.8 $\mu$m on the surface of each substrate.

In this respect, the speed with which the substrate is inserted into or taken out from the furnace is 60 mm per minute.

Here, using an etchpit method the measurement of dislocation density for each one substrate of the experimental specimens is conducted after removing the thermal oxidation $SiO_2$ layer of the substrate by etching.

For the etching, Secco ethant is used to remove an amount of approximately 5 $\mu$m for five minutes. The etchpit measurement positions are those obtained by dividing the longitudinal side of the substrate by 10 equally and 2 mm inside from each end. At such positions, an average of four visual fields of a metal microscope of 200 magnification is obtained. Then, the larger value on the two sides of the longitudinal side of the substrate is defined as the measurement value.

Subsequently, liquid jet recording head substrates are fabricated using Si substrates prepared likewise for each of the experiments. Then, such substrates are sliced by a slicer into rectangulars for the measurement of curves in order to confirm the effectiveness of the present invention.

The fabrication of the substrate is: at first, utilizing the photolithographical patterning technique, an exothermic resistive layer 2 composed of $HfB_2$ as shown in FIG. 5 (20 $\mu$m×100 $\mu$m, film thickness 0.16 $\mu$m, and wiring density, 16 Pel) and electrodes 3 (film thickness 0.6 $\mu$m and width 20 $\mu$m) composed of Al connected to each of the exothermic resistive members 2*a* are formed on the Si substrate for the head assembling. Then, on the portion where the electrodes and exothermic resistive members are formed, a protective layer 4 (film thickness 2 $\mu$m/0.5 $\mu$m) of $SiO_2$/Ta is formed by sputtering. Subsequently, as shown in FIG. 6, liquid passages 6, a liquid chamber (not shown), and others are formed by dry film. Lastly, both end portions of the substrate are sliced by a slicer to obtain rectangulars of 10 mm wide as curving measurement samples A and B.

Then, the samples thus prepared are placed on a precision XY table with a linear scale to measure the curves. After that, all the required processes to fabricate the liquid jet recording head are conducted including the grinding of the sliced surface (discharging surface), IC die bonding, and other assembling process. It is thus confirmed that there are no drawbacks encountered during all these processes.

In this respect, it is arranged that the both ends are cut off in advance for use when the liquid jet recording head is fabricated or the both ends are not used as the head portion by setting them aside as dummy use.

The results are shown in Table 1.

TABLE 1

| Experiment No. | 1 | 2 | 3 | 4 | 5 | 6 |
|---|---|---|---|---|---|---|
| Corner shape of substrate | right angle | R 2 | R 6 | R 8 | R 15 | right angle |
| Thermal oxidation layer thickness ($\mu$m) | 2.8 | 2.8 | 2.8 | 2.8 | 2.8 | 0 |
| Maximum curving amount ($\mu$m) | +90 | +82 | +20 | −5 | +3 | −4 |
| Maximum curved position | Almost center | Almost center | Almost center | From center 100 mm | From center 70 mm | From center 90 mm |
| Defective ratio in manufacture (%) | 100 | 100 | 50 | 0 | 0 | 0 |

TABLE 1-continued

| Experiment No. | 1 | 2 | 3 | 4 | 5 | 6 |
|---|---|---|---|---|---|---|
| Dislocation density by etchpit method (pieces/cm$^2$) | $2.0 \times 10^5$ | $2.0 \times 10^5$ | $5.0 \times 10^4$ | $1.0 \times 10^3$ | $8.0 \times 10^2$ | $2.0 \times 10^2$ |

Figure 1:
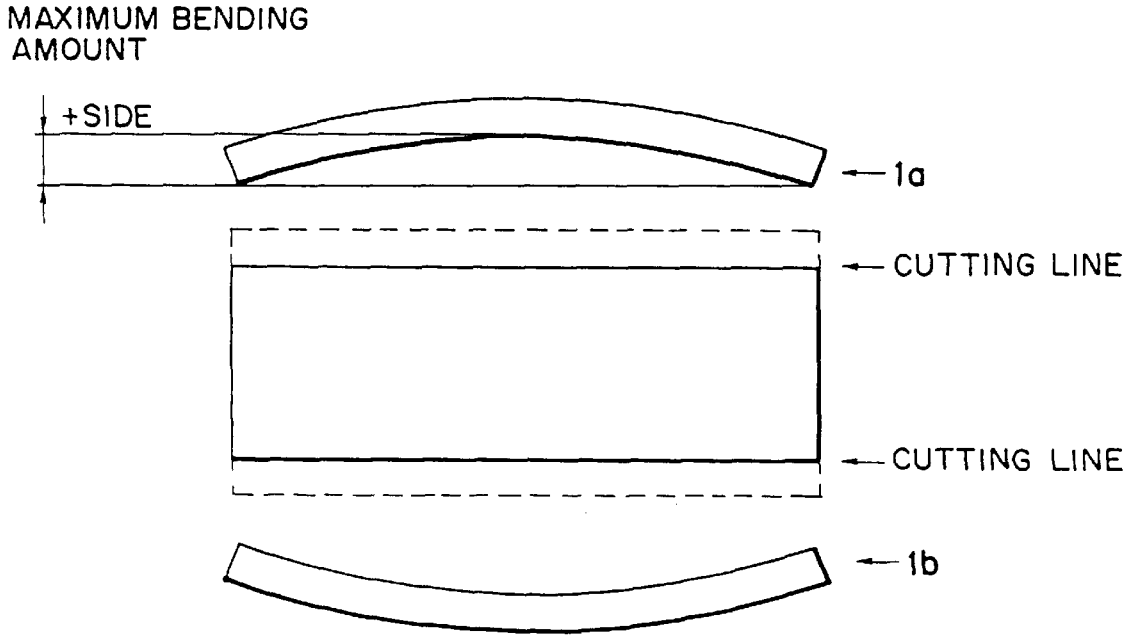
FIG. 1 is a schematic view illustrating the state where bowed curves are created.
Figure 2A:
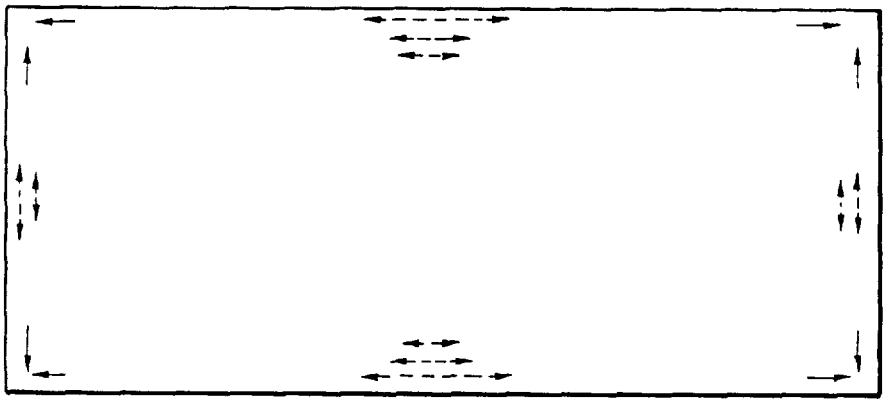
FIGS. 2A and 2B illustrate the generation of stresses during the thermal oxidation process.
Figure 2B:
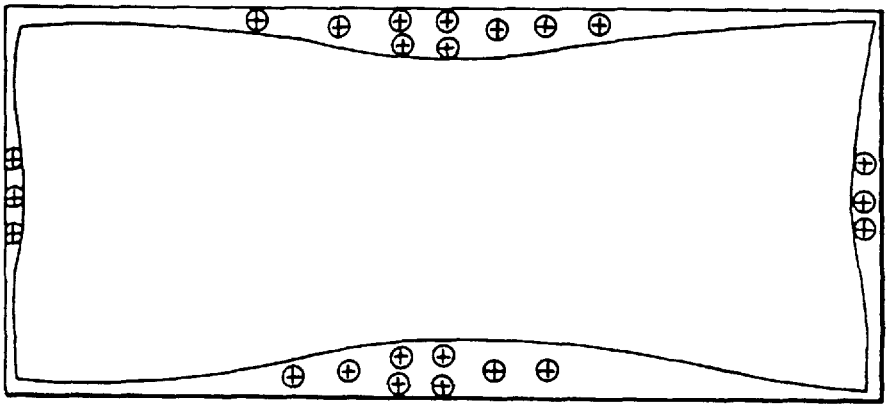

The number of samples is 10. The maximum curving amount is defined as + for the one convexed toward both ends of the substrate from the center of the shorter side thereof (see FIG. 1) and as − for the one concaved in the same manner.

Up to the experiment No. 3, the specimens are curved like a bow symmetrically with the substantial center of the specimen as the position representing its maximum curve. In contrast, the specimens Nos. 4 and 5 the dislocation density of which is less than $1.0\times10^3$ pieces/cm$^2$ by the application of the etchpit method do not show such a tendency, and the maximum amount of curve is almost the same as the specimen No. 6 having no thermal oxidation layer. This is within the range of tolerance (±5 $\mu$m) set for the slicing in consideration of the designed values. Any defects due to the bowed curve are noticed in the fabrication process, as well.

It is ascertained from these experiments that the dislocation density on the substrate surface can be reduced by rounding the end portions of the substrate at the time of thermal oxidation, and that the production yield can be increased if this dislocation density is less than $5.0\times10^4$ and it can be further increased if the density is less than $1.0\times10^3$. Also, when the ejection characteristics are examined by preparing the ink jet heads using the substrate produced from each of the specimens, it is found that, inverse proportion to the defects ratio, desirable recordings are performed with the dislocation density of less than $5.0\times10^4$ and that extremely desirable images can be obtained with the dislocation density of less than $1.0\times10^3$.

Embodiment 2

Figure 4:
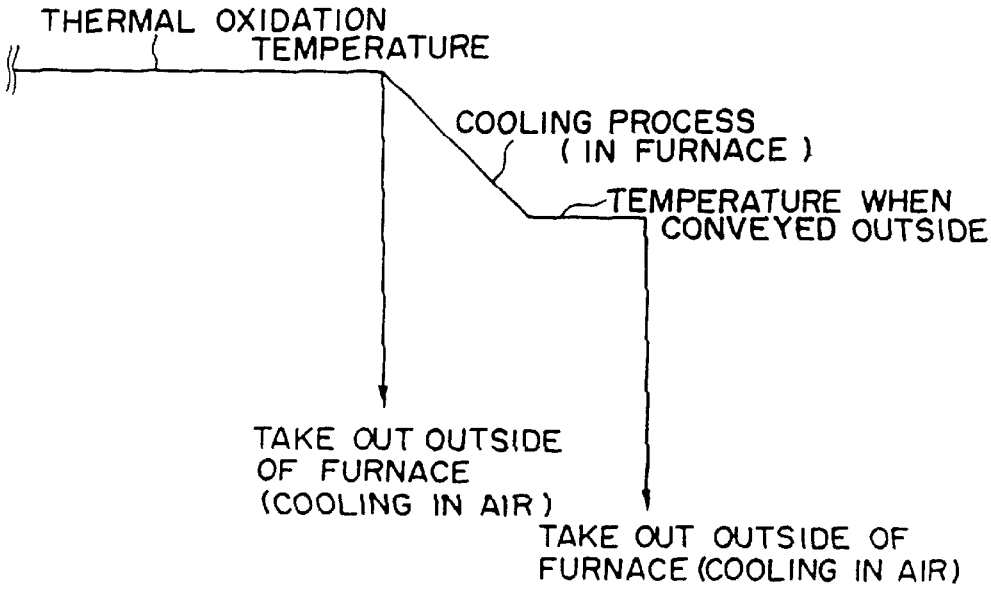
FIG. 4 is a graph illustrating the profile of the cooling temperatures after the thermal oxidation heating.

For the square substrate which is the same as the embodiment 1, the thermal dioxidation is conducted with oxygen introduced by bubbling method to obtain the thermal oxidation layer of 3 $\mu$m. The thermal process is given at a temperature of 1,150° C. for 14 hours. Cooling is conducted from the holding temperature in accordance with each experimental condition. In this respect, as shown in FIG. 4, the air cooling is conducted by taking out the substrate to the outside of the furnace without any furnace cooling. When it is cooled through the furnace cooling, the cooling speed in the cooling process therein is regulated. Then, the substrate is taken out from the furnace to the outside after the furnace temperature reaches the one enabling it to be taken out therefrom. Also, each specimen substrate is taken out from the furnace at 60 mm/minute.

Here, using one substrate per experiment, the $SiO_2$ layer of the substrate is removed by etching and then the dislocation density is measured by etchpit method as in the embodiment 1.

Subsequently, using the Si substrate thus prepared, the liquid jet recording head supporting member substrate is fabricated as in the embodiment 1, and is sliced by a slicer into rectangles for the measurement of the generation of curves in the same manner as the embodiment 1. Hence the effectiveness of the present invention is confirmed. The results are shown in Table 2.

TABLE 2

| Experiment No. | 7 | 8 | 9 | 10 | 11 | 12 | 13 | 14 |
|---|---|---|---|---|---|---|---|---|
| Thermal oxidation layer thickness ($\mu$m) | 3 | 3 | 3 | 3 | 3 | 3 | 3 | 0 |
| Cooling method | air cooling | furnace cooling | furnace cooling | furnace cooling | furnace cooling | furnace cooling | furnace cooling | — |
| Cooling speed (°C./minute) | — | 2.5 | 30 | 10 | 2.5 | 2.5 | 1.5 | — |
| Temperature at which to take-out substrate from furnace (°C.) | 1150 | 1000 | 850 | 850 | 850 | 600 | 600 | — |
| Maximum curving amount ($\mu$m) | +90 | +85 | +92 | +15 | −5 | −5 | +3 | — |
| Maximum curved position (value: mm) | Center | Center | Center | Center | From center 100 | From center 90 | From center 65 | From center 90 |
| Defective ratio in manufacture (%) | 100 | 100 | 100 | 50 | 0 | 0 | 0 | 0 |

TABLE 2-continued

| Experiment No. | 7 | 8 | 9 | 10 | 11 | 12 | 13 | 14 |
|---|---|---|---|---|---|---|---|---|
| Dislocation density by etchpit method (pieces/cm$^{2)}$ | $2.0 \times 10^5$ | $2.3 \times 10^5$ | $1.2 \times 10^5$ | $3.0 \times 10^4$ | $1.0 \times 10^3$ | $8.0 \times 10^2$ | $7.5 \times 10^2$ | $2.0 \times 10^2$ |

The number of samples is 10. The maximum curving amount is defined as + for the one convexed toward both ends of the substrate from the center of the shorter side thereof and as − for the one concaved in the same manner.

According to the experiment No. 7 where no furnace cooling is conducted, No. 8 where the temperature at which the substrate is taken out from the furnace is high, and Nos. 9 and 10 where the cooling speed is high, each of the substrates presents the curves symmetrically bowed with the substantial center as the maximum curving position. In contrast, the specimens Nos. 11 to 14 the dislocation density of which is less than $1.0\times10^3$ pieces/cm$^2$ by the application of the etchpit method do not show such a tendency, and the maximum amount of curve is almost the same as the specimen (No. 14) having no thermal oxidation layer. This is within the range of tolerance (±5 $\mu$m) set for the slicing in consideration of the designed values. Any defects due to the bowed curve are noticed in the fabrication process, as well.

As described above, it is possible to reduce the dislocation density by controlling the cooling speed for the substrate at less than 10° C./minute or more preferably at less than 2.5° C./minute thereby to obtain substrates having no warping or curves as well as recording heads capable of performing desirable recordings.

Figure 6A:
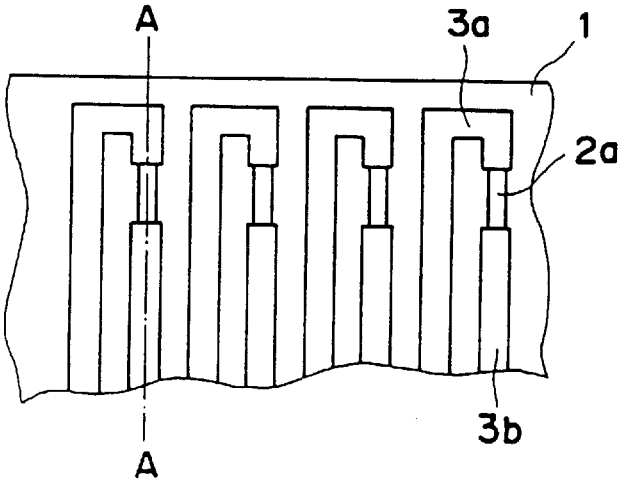
FIGS. 6A and 6B illustrate a liquid jet recording head substrate.
Figure 6B:
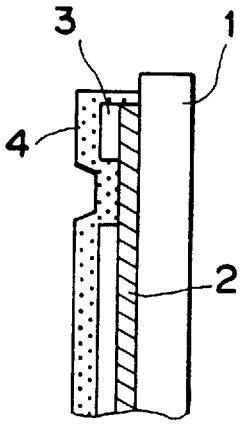
Figure 7:
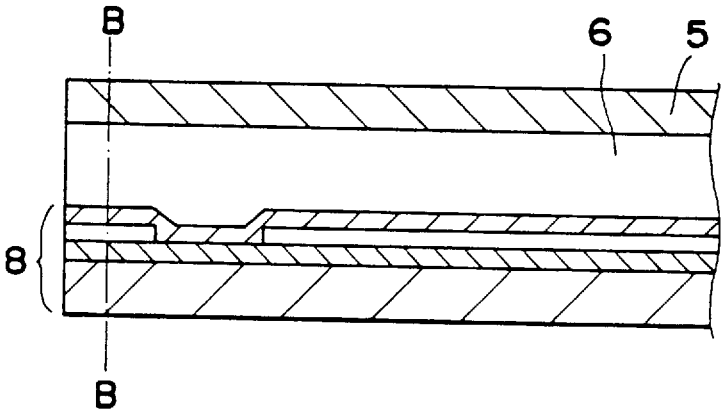
FIG. 7 is a cross-sectional view of a liquid jet recording head.

In this respect, the heat accumulation layer described in each of the above-mentioned embodiments is good enough if only it is formed at least in the position where the exothermic resistive members are provided on the supporting member 1. It may also be possible to form the layer all over the surface of the supporting member 1. On the $SiO_2$ layer of the supporting member, electrothermal transducers are formed by patterning the electrode layer 3 and exothermic resistive layer 2 into a given configuration as shown in FIGS. 6A and 6B, for example. Then, if required, the protective layer 4 is provided. It is thus possible to obtain the substrate 8 for the liquid jet recording head.

Also, the configurations of the electrothermal transducer and the structure of the protective layer 4 are not limited to those shown in the respective drawings.

Figure 5A:
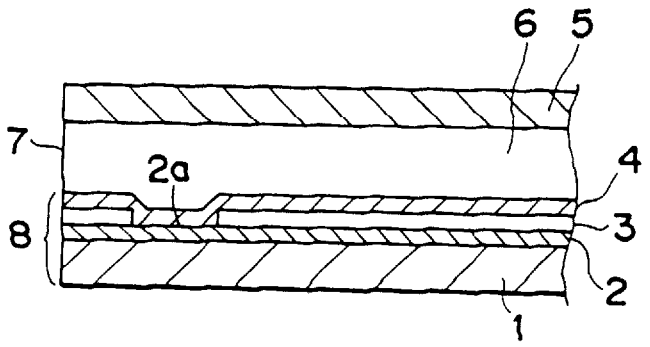
FIGS. 5A and 5B are views illustrating a liquid jet recording head.
Figure 5B:
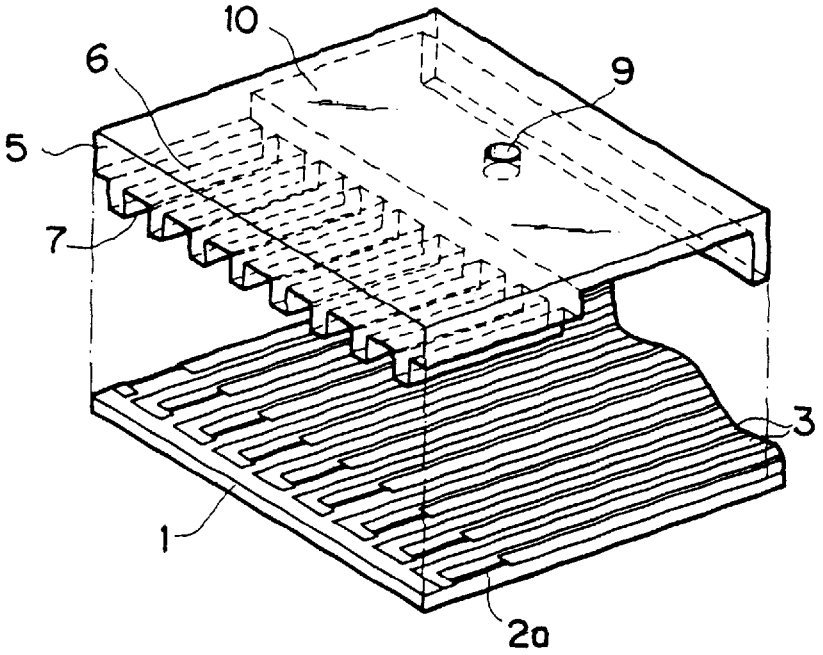

Then, the liquid jet recording head can be formed by the liquid passages 6, discharging ports 7, and liquid chamber 10 as required on the liquid jet recording head substrate 8 as shown in FIGS. 5A and 5B, for example.

In this respect, the structure of the liquid jet recording head is not limited to those shown in the respective drawings. The recording head exemplified in the accompanying drawings is of such a structure that the direction in which liquid is ejected from the discharging ports and the direction in which the liquid is supplied to the locations where the thermal active portions of the thermal energy generating members in the liquid passages are substantially the same. However, the present invention is not limited thereto, but it is applicable to a liquid jet recording head wherein the foregoing two directions are different from each other (the two directions are almost vertical, for example).

The present invention is effectively applicable to ink jet recording methods. Particularly, among them, this invention demonstrates an excellent effect for the use of the recording head and recording apparatus wherein ink is ejected by utilizing thermal energy.

Regarding the typical structure and operational principle of such a method, it is preferable to adopt those which can be implemented using the fundamental principle disclosed in the specifications of U.S. Pat. Nos. 4,723,129 and 4,740,796. This method is applicable to so-called on-demand type recording system and a continuous type recording system. Particularly, however, it is suitable for the on-demand type because the principle is such that at least one driving signal, which provides a rapid temperature rise beyond a departure from nucleating boiling point in response to recording information, is applied to an electrothermal transducer disposed on a liquid (ink) retaining sheet or liquid passage whereby to cause the electrothermal transducer to generate thermal energy to produce film boiling on the thermoactive portion of the recording head; thus effectively leading to the resultant formation of a bubble in the recording liquid (ink) one to one for each of the driving signals. By the development and contraction of the bubble, the liquid (ink) is ejected through a discharging port to produce at least one droplet. The driving signal is preferably in the form of pulses because the development and contraction of the bubble can be effectuated instantaneously, and, therefore, the liquid (ink) is ejected with quick response. The driving signal in the form of pulses is preferably such as disclosed in the specifications of U.S. Pat. Nos. 4,463,359 and 4,345,262. In addition, the temperature increasing rate of the heating surface is preferably such as disclosed in the specification of U.S. Pat. No. 4,313,124 for an excellent recording in a better condition.

The structure of the recording head may be as shown in each of the above-mentioned specifications wherein the structure is arranged to combine the discharging ports, liquid passages, and the electrothermal transducers as disclosed in the above-mentioned patents (linear type liquid passage or right angle liquid passage). Besides, the structure such as disclosed in the specifications of U.S. Pat. Nos. 4,558,333 and 4,459,600 wherein the thermal activation portions are arranged in a curved area is also included in the present invention. In addition, the present invention is applicable to the structure disclosed in Japanese Laid-Open Application No. 59-123670 wherein a common slit is used as the discharging ports for plural electrothermal transducers, and to the structure disclosed in Japanese Patent Laid-Open Application No. 59-138461 wherein an opening for absorbing pressure wave of the thermal energy is formed corresponding to the discharging ports. In other words, according to the present invention, it becomes possible to operate the recording assuredly irrespective of the modes of the recording head.

Furthermore, as a full line type recording head having a length corresponding to the maximum recording width, it may be possible to arrange a structure either by combining plural recording heads disclosed in the above-mentioned specifications or by a single recording head integrally constructed to cover such a length.

In addition, the present invention is applicable to a placeable chip type recording head which is connected electrically with the main apparatus and can be supplied with ink when it is mounted in the main assembly, or to a cartridge type recording head having an integral ink container.

Also, it is preferable to additionally provide recording head recovery means and preliminarily auxiliary means which are arranged as constituents of a recording apparatus according to the present invention. These elements will contribute to making the effectiveness of the present invention more stabilized. To name them specifically, such elements are capping means for the recording head, cleaning means, compression or suction means, preliminary heating means such as electrothermal transducers or heating elements other than such transducing type or the combination of those types of elements, and the preliminary ejection mode besides the regular ejection for recording.

As regards the recording mode of the recording apparatus, whether it may be for a major color such as black or its recording head is integrally structured itself or by a combination of a plurality of heads, the present invention is extremely effective in applying it to an apparatus having at least one of multi-color modes with different color ink materials or full-color modes using the mixture of the colors.

Now, in the embodiments according to the present invention set forth above, while the ink has been described as liquid, it may be an ink material which is solidified below the room temperature but liquefied at the room temperature. Since the ink is controlled within the temperature not lower than 30° C. and not higher than 70° C. to stabilize its viscosity for the provision of the stable ejection in general, the ink may be such that it can be liquefied when the applicable recording signals are given.

In addition, while preventing the temperature rise due to the thermal energy by the positive use of such energy as an energy consumed for changing states of the ink from solid to liquid, or using the ink which will be solidified when left intact for the purpose of preventing ink evaporation, it may be possible to apply to the present invention the use of an ink having a nature of being liquefied only by the application of thermal energy such as an ink capable of being ejected as ink liquid by enabling itself to be liquefied anyway when the thermal energy is given in accordance with recording signals, an ink which will have already begun solidifying itself by the time it reaches a recording medium.

For an ink such as this, it may be possible to retain the ink as a liquid or solid material in through holes or recesses formed in a porous sheet as disclosed in Japanese Patent Laid-Open Application No. 54-56847 or Japanese Patent Laid-Open Application No. 60-71260 in order to execute a mode whereby to enable the ink to face the electrothermal transducers in such a state.

For the present invention, the most effective method for each of the above-mentioned ink materials is the one which can implement the film boiling method described above.

Figure 8:
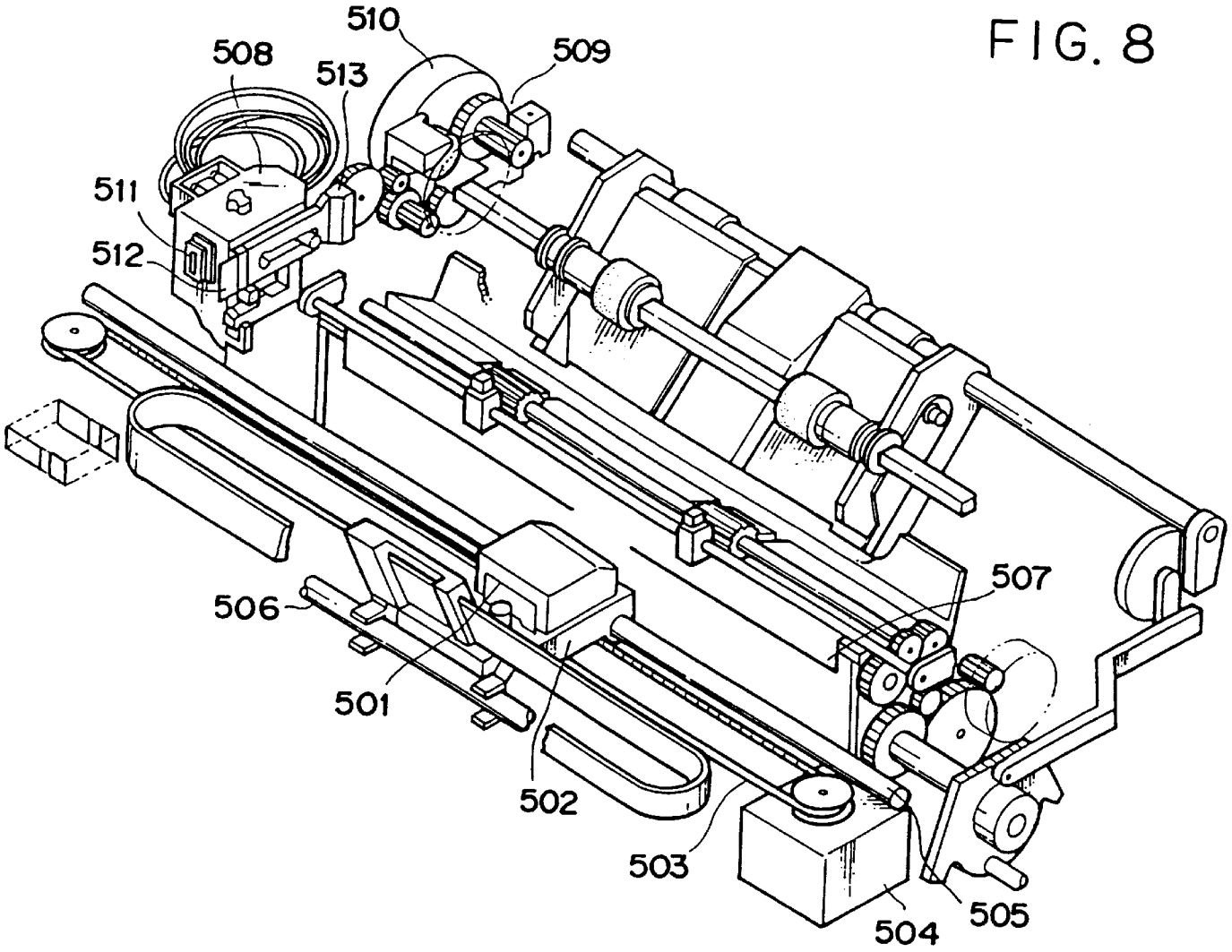
FIG. 8 is an external perspective view showing an example of a recording apparatus in which a recording head of the present invention is mounted.

FIG. 8 is a perspective view illustrating the external appearance of an example of the ink jet recording apparatus which is provided with the structure to execute the above-mentioned processes.

In FIG. 8, a reference numeral 501 designates an ink head cartridge (IJC) provided with the nozzle group to eject ink onto the recording surface of a recording sheet which has been fed to a platen 507; 502, a carriage (HC) to hold the IJC 501 and which is connected to a part of a driving belt 504 for transmitting the driving force of a driving motor 503. The carriage is slidably mounted on the two guide shafts 505 and 506 which are arranged in parallel to each other thereby to enable the IJC 501 to reciprocate over the entire width of the recording sheet.

A reference numeral 508 designates a head recovery unit and is positioned at one end of the traveling path of the IJC 501, a position opposite to its home position, for example. The head recovery unit 508 is operated by the driving force of a motor 510 through a driving force transmission mechanism 509 to cap the IJC 501. Interlocking with this capping to the IJC 501 by the capping device 511 of the head recovery unit 508, an appropriate suction means arranged in the head recovery unit 508 is allowed to perform an ink suction or an appropriate pressure means arranged in the ink supply passage to the IJC 501 is allowed to perform a pressurized ink supply; thus executing the ejection recovery process such as the removal of the ink which has become overly viscous in nozzles by forcibly ejecting such ink from the discharging ports. Also, when the recording operation is terminated, the capping is performed to protect the recording head.

A reference numeral 512 designates a cleaning blade arranged at the side end of the head recovery unit 508. The blade 512 is held by a blade holding member 513 in a cantilever fashion, and is operated by the motor 510 and the driving force transmission mechanism 509 in the same manner as the head recovery unit 508; hence enabling it to engage with the discharging surface of the IJC 501. In this way, with an appropriate timing in a recording operation of the IJC 501 or after an ejection recovery process using the head recovery unit 508, the blade 512 is protruded to the traveling path of the IJC 501 to wipe off dews, wets, or dust particles on the discharging surface of the IJC 501 as the IJC 501 is operated to travel.

Also, this recording apparatus has recording signal supplying means to provide the foregoing recording head with the signals to drive the recording head.

Further, while the description has been made of a printer as an example of the recording apparatus which performs recordings on a sheet or the like, the present invention is applicable to a textile printing apparatus which uses clothes as its recording medium.

In the textile printing apparatus, it is required to perform recording at a high speed for extremely wide clothes. It is particularly desirable to apply a recording head of the present invention which enables an elongated recording in an excellent condition in such a case.

Then, it is more desirable to use this textile printing apparatus as a core of a textile printing system with a combination of a pre-processing apparatus required to improve the recording quality, a post-processing apparatus, and others.

According to the present invention, it is possible to eliminate the curves of the substrate which will be created when it is cut for the fabrication of a liquid jet recording head and to implement the cost reduction by improving the utilization efficiency of the substrates. At the same time, it becomes possible to provide the liquid jet recording head substrate having an excellent heat releasability, durability, and elongation capability as well as a liquid jet recording apparatus using such a substrate.

What is claimed is:

1. A method for manufacture of a treated substrate for a liquid jet recording head having a supporting member with an oxidized film on its surface, exothermic resistive members arranged on said oxidized film, and wirings electrically connected to said exothermic resistive members, comprising the following steps:

shaping the corners of a monocrystal supporting member to be circular arcs so as not to allow a dislocation density of the supporting member to exceed $5\times10^4$ pieces/$cm^2$ due to a thermal oxidation process, and at the same time, smoothing the surface of said supporting member;

forming an oxidized layer at least on a part of the surface of said supporting member by a thermal oxidation process performed on said substrate; and forming said exothermic resistive members on said oxidized layer.

2. A method for manufacture of a treated substrate for a liquid jet recording head having a supporting member with an oxidized film on its surface, exothermic resistive members arranged on said oxidized film, and wirings electrically connected to said exothermic resistive members, comprising the following steps:

preparing a supporting member having a smooth surface;

forming an oxidized layer at least on a part of the surface of said supporting member by a thermal oxidation process performed on said substrate, and setting the cooling speed at less than 10° C./minute when said supporting member is cooled; and forming said exothermic resistive members on said oxidized layer.

* * * * *

UNITED STATES PATENT AND TRADEMARK OFFICE

CERTIFICATE OF CORRECTION

PATENT NO. : 5,820,919
DATED : October 13, 1998
INVENTOR(S) : Haruhiko Terai

It is certified that error appears in the above-identified patent and that said Letters Patent is hereby corrected as shown below:

Title page [22],
Filing date, "Jan. 2," should read -- Jan. 3, --.

Column 4,
Line 1, "member," should read -- member. --.

Column 8, table 2,
Line 55, "take-" should read -- take --.

Signed and Sealed this

Twenty-fifth Day of September, 2001

*Attest:*

Nicholas P. Godici

NICHOLAS P. GODICI
*Acting Director of the United States Patent and Trademark Office*

*Attesting Officer*